US005810097A

United States Patent [19]

McMillan

[11] Patent Number: 5,810,097

[45] Date of Patent: Sep. 22, 1998

[54] ATTACHMENT SYSTEM FOR MOUNTING ROAD-MAINTENANCE EQUIPMENT ON A VEHICLE

[76] Inventor: Perry Darrell McMillan, P.O. Box 626, Rosebud, Alberta T0J 2T0, Canada

[21] Appl. No.: 779,683

[22] Filed: Jan. 7, 1997

[30] Foreign Application Priority Data

Jul. 17, 1996 [CA] Canada ..... 2181426

[51] Int. Cl.[6] ..... E02F 3/76

[52] U.S. Cl. ..... 172/782; 172/785; 172/452; 172/666; 172/668; 172/675

[58] Field of Search ..... 172/780, 782, 172/785, 797, 240, 242, 244, 321, 397, 600, 666, 668, 675, 810, 140, 311, 454, 452; 37/105, 281, 279, 282

[56] References Cited

U.S. PATENT DOCUMENTS

| | | | |
|---|---|---|---|
| Re. 34,860 | 2/1995 | Skibsted . | |
| 2,321,401 | 6/1943 | Lull . | |
| 2,611,196 | 9/1952 | Barrett et al. | 172/785 |
| 2,659,988 | 11/1953 | Braden et al. . | |
| 2,713,220 | 7/1955 | Muenchow . | |
| 2,876,564 | 3/1959 | Briscoe | 172/782 X |
| 2,948,973 | 8/1960 | Magouirk et al. | 172/782 X |
| 3,080,930 | 3/1963 | Morkoski et al. . | |
| 3,815,268 | 6/1974 | Yard | 172/782 X |
| 4,331,206 | 5/1982 | Linton . | |
| 4,834,191 | 5/1989 | Vecchio . | |
| 4,848,483 | 7/1989 | Heiple . | |
| 5,076,370 | 12/1991 | Stubben et al. . | |
| 5,108,221 | 4/1992 | Skibsted . | |
| 5,337,834 | 8/1994 | Tapphorn . | |

FOREIGN PATENT DOCUMENTS

| | | | |
|---|---|---|---|
| 493074 | 5/1953 | Canada | 172/785 |
| 2029695 | 5/1993 | Canada . | |
| 2253329 | 5/1973 | Germany | 172/785 |
| 162635 | 3/1958 | Sweden | 172/782 |
| 386083 | 9/1973 | U.S.S.R. | 172/782 |

*Primary Examiner*—Michael J. Carone
*Assistant Examiner*—Christopher J. Novosad
*Attorney, Agent, or Firm*—Merchant, Gould, Smith, Edell, Welter & Schmidt

[57] ABSTRACT

An attachment system for mounting road-maintenance equipment on a vehicle such as a motor grader includes a frame for mounting on the nose plate of the vehicle to support the conditioning equipment forwardly and partly outboard of the vehicle. The system includes pivotal attachment mounts for the front and rear ends of a draft frame of the conditioning equipment together with a strut for supporting the draft frame at a desired orientation during operation, and for raising the draft frame and surface conditioning equipment to a retracted position when not in use. A mast on the attachment system frame directs a cable to the rear end of the draft frame to effect raising movement of the latter to the transport position.

15 Claims, 5 Drawing Sheets

ATTACHMENT SYSTEM FOR MOUNTING ROAD-MAINTENANCE EQUIPMENT ON A VEHICLE

FIELD OF THE INVENTION a) Background of the Invention

This invention relates to a new or improved attachment system for mounting road-maintenance equipment including surface-conditioning equipment on a wheeled tractor vehicle so that the equipment is deployed outboard of the forward end of the vehicle. The invention also relates to a combination of such equipment with a vehicle, and in particular although not exclusively with a motor grader.

b) Description of the Prior Art

The novel attachment system has been developed specifically to provide an arrangement for mounting onto a motor grader, surface conditioning equipment such as the apparatus described in Canadian Patent 2,029,695 Skibsted issued May 25, 1993, and sold under the Trademark THE RETRIEVER, but is envisaged to have broader application to attach equipment and implements of various types to tractor vehicles, and in particular to motor graders.

The concept of mounting implements on the nose plate of a motor grader is not new, but hitherto such implements have been limited to types that operate basically in front of and within the track of the motor grader although perhaps extending partly to one side. There has not up to now been available a mounting system which would permit the attachment to the nose plate of a motor grader of surface-conditioning equipment to be deployed outboard of the front wheel of the motor grader, and movable between an operating position and a raised transport position, while at all times having sufficient clearance from the grader front wheel as to present no obstacle to the maneuverability of the wheel throughout its full range of operating positions.

There has not up to now been available a mounting system which would permit the attachment to the nose plate of a motor grader of surface-conditioning equipment to be specifically used in front of the mouldboard in conditioning the surface for immediate secondary conditioning with the mouldboard. This mounting system provides the duality which doubles the grader's efficiency in shoulder conditioning projects. It also doubles the grader's efficiency in independent activities, the front mounted conditioner can work the shoulder while the mouldboard works the road surface.

SUMMARY OF THE INVENTION

The present invention provides an attachment system for mounting surface-conditioning equipment at the forward end of a tractor vehicle, such equipment comprising an elongate draft frame having an inboard end and an outboard end, said system comprising: a rigid mounting frame configured to be fixedly connected in a releasable manner at least indirectly to a nose plate located at the front of the tractor vehicle, said mounting frame including: a bracket carried on said mounting frame and a connector on said bracket for providing pivotal attachment for the inboard end of the draft frame of the surface-conditioning equipment; a remotely operable lift mechanism on said mounting frame for attachment to the draft frame at a location distant from said inboard end, and operable to effect a pivotal lifting action of said draft frame about said pivotal attachment at the inboard end thereof; said attachment system functioning to carry the draft frame in an operative position at the forward end of and at least partially one side of the tractor vehicle to draw the surface conditioning equipment, by means of the inboard end of the draft frame, over the ground surface upon forward movement of the vehicle, said lift mechanism being selectively operable to raise the draft frame to a retracted position by causing it to pivot upwardly about its inboard end.

The expression "surface-conditioning equipment" is intended to include not just surface conditioning equipment such as THE RETRIEVER, but also equipment such as mowers, sprayers etc.

The mounting frame could be designed for indirect connection to the nose plate via a "quick attach" coupling.

Preferably the bracket is carried on a vertically oriented linear guide member controlled by an hydraulic system that is operated independently by the driver from the cab of the vehicle, this system including a horizontally deployed hydraulic cylinder coupled to the bracket via a cable and pulley drive, the arrangement providing a vertically adjustable pivotal mounting for the front inboard end of the draft frame forwardly of the vehicle front wheel. The lift mechanism of the mast preferably also includes an hydraulic cylinder which is operable through a cable and pulley system to control the height of the rear part of the draft frame, and to pivot the draft frame when desired to a raised transport position alongside the vehicle. The outer portion of the draft frame is supported in the desired operating orientation e.g. at an angle in the range 15° to 35° from the fore-and-aft direction of the vehicle by a length-adjustable strut which has a rear end pivotally attached to a rigid anchor point provided on a brace frame that is connected to the frame on the vehicle, and is pivotal about this anchor point to accommodate both adjustments in the angular deployment of the equipment and its movement between the operative position and the transport position.

The invention also provides the combination of such an attachment system with a motor grader vehicle, this combination enabling surface conditioning of a road shoulder in a single pass since the conditioning equipment such as "THE RETRIEVER" is mounted forwardly of the grader's moldboard so that the latter can operate independently to move displaced material laterally of the road surface as it follows passage of THE RETRIEVER.

The invention will further be described, by way of example only, with reference to the accompanying drawings wherein.

Figure 1:
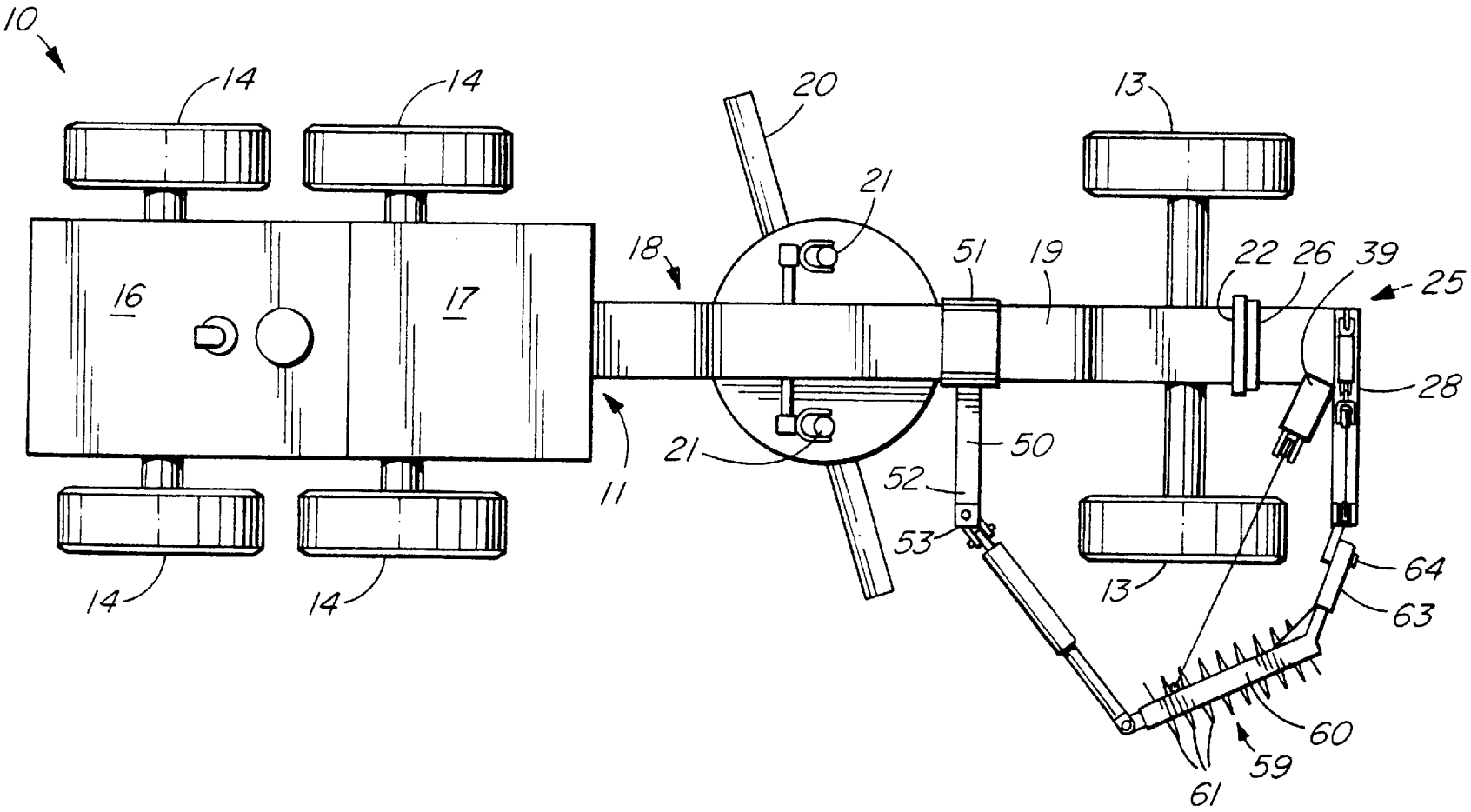
FIG. 1 is a somewhat schematic plan view of a motor grader fitted with an attachment system in accordance with the present invention.
Figure 3:
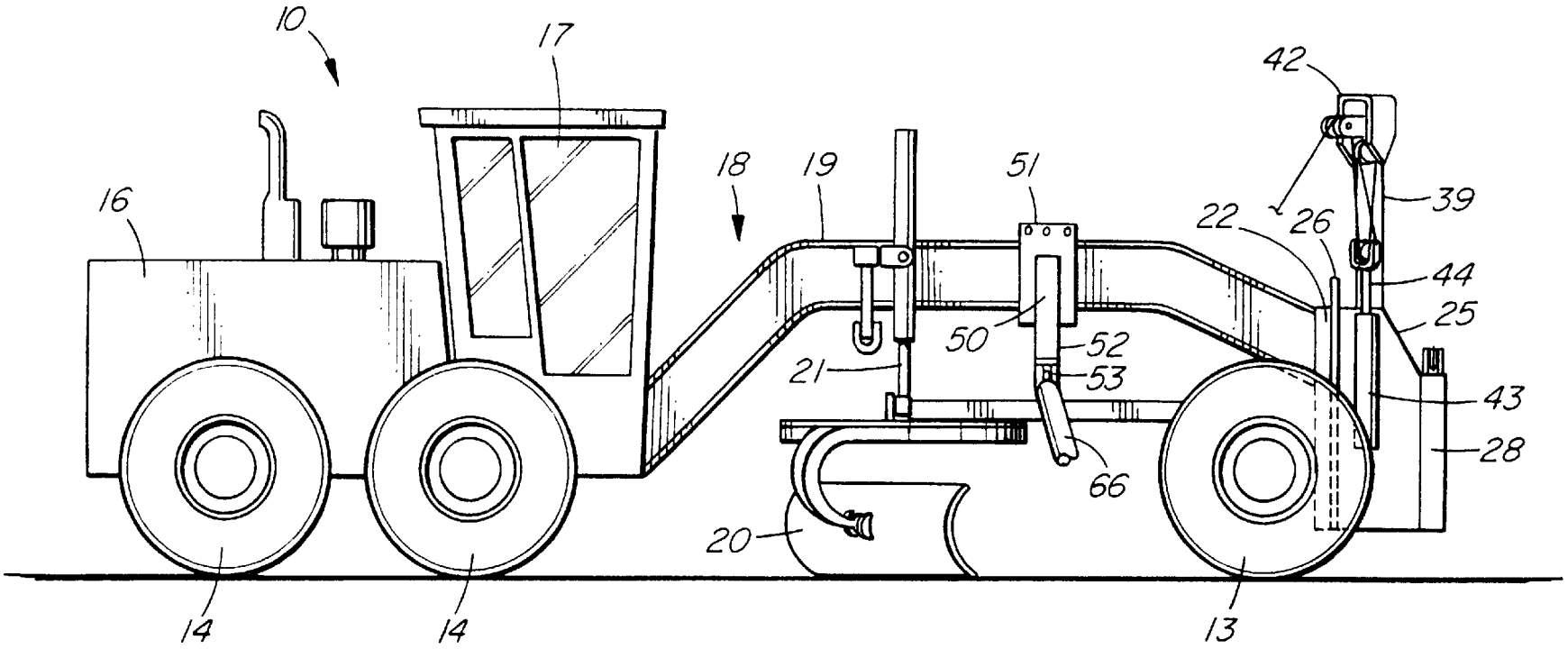
FIG. 3 is a somewhat schematic side view showing the motor grader and attachment system, but without the surface-conditioning equipment.
Figure 4:
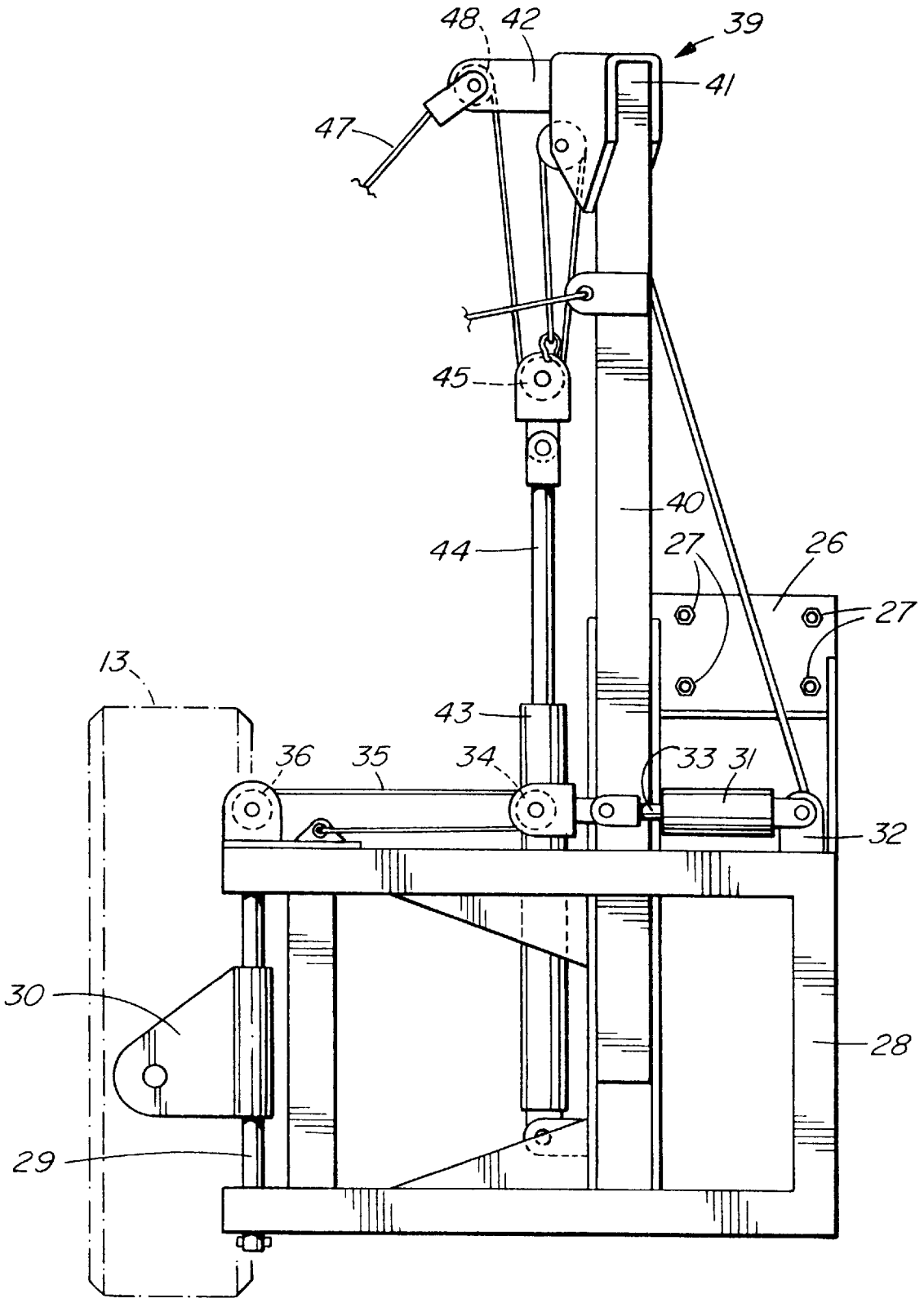
FIG. 4 is a partial front view illustrating the mounting frame of the attachment system.

As seen in FIG. 1 a motor grader 10 has a body 11 supported on steerable and manoeuvrable front wheels 13 and on rear wheels 14. The body includes an engine compartment 16 forward of which is an operator's cab 17. Forward of the cab 17 the grader comprises a stiff central longitudinal box section frame 18 the central portion 19 of which is upwardly offset to provide clearance for the moldboard blade 20 which is suspended therebeneath, the deployment attitude of the moldboard being controlled by the vehicle driver through a conventional operating system 21. The front end of the central frame 18 terminates in a transversely oriented vertical nose plate 22 located between the front wheels 13 as seen in FIGS. 1 and 3.

The attachment system of the present invention comprises a strong box frame 25 having a flange 26 at the rear thereof through which the frame is releasably secured to the nose plate 22 by threaded bolts 27. The box frame is fabricated from welded sections of steel plate and tube and as seen in FIG. 3 has a rectangular front mount frame 28 positioned forwardly of the front wheels 13 and extending transversely in a generally vertical plane. As clearly shown in FIG. 2, the front mount frame 28 is offset laterally towards one side, in which location it supports a vertically extending cylindrical guide rod 29 the opposite ends of which are anchored in the frame 28. The guide rod 29 passes through a massive bracket 30 which is guided for movement vertically on the guide rod. An actuator system for controlling movement of the bracket 30 along the guide rod comprises an hydraulic cylinder 31 arranged horizontally along the upper side of the front mount frame, one end of the cylinder being pivotally attached to a lug 32 on the frame. A piston rod 33 extending from the cylinder carries a sheave 34. A flexible steel cable system 35 cooperating with the sheave 34 passes over a pulley 36 mounted on the frame 28 from which it extends downwardly to an attachment point 37 on the bracket 30. From this it will be realized that extension of the piston rod 33 with respect to the cylinder 31 will allow the bracket 30 to move downwardly on the guide rod 29 whereas retraction of the piston rod will act through the cable 35 to move the bracket 30 upwardly.

The box frame 25 also supports thereon a vertically extending mast 39 having a lower portion 40 fixedly secured to the frame 25 and an upper portion 41 having a laterally projecting arm 42, the upper part 41 being mounted for angular movement about the vertical axis. A second hydraulic cylinder 43 is vertically oriented and mounted in the frame 25 alongside the lower part 40 of the mast and has a piston rod 44 extending vertically upwards therefrom, the piston rod carrying cable sheaves 45. Further cable sheaves 46 is rotatably mounted in the underside of the arm 42, and a flexible steel cable 47 trained around the sheaves 45 and 46 and having one end anchored to the piston rod, has a second end that passes over a pulley 48 at the outer end of the arm 42 and extends outwardly therefrom.

Figure 5:
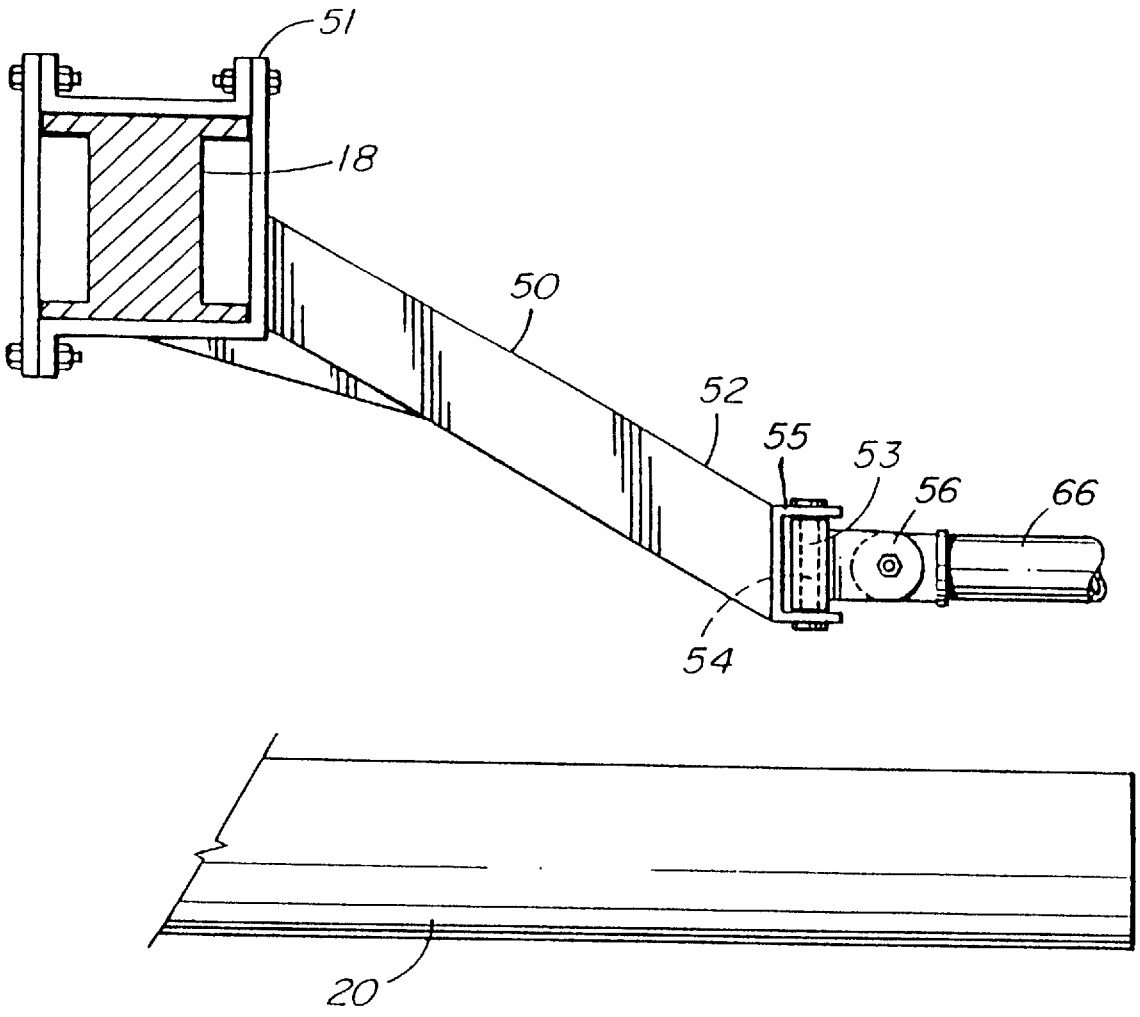
FIG. 5 is a somewhat schematic view illustrating the surface conditioning equipment in relation to the mould board of the motor grader.

The attachment system also includes a brace frame 50 of rigid hollow steel construction having a mounting flange 51 formed to receive bolts for fixedly attaching the brace frame 50 to the central portion 19 of the motor grader frame. The frame 50 extends outwardly and downwardly of the motor grader frame terminating at a lower end 52 in which is supported a swivel bracket 53 which provides an anchor point for attachment of a strut that supports surface-conditioning equipment as will later be described. The swivel bracket 53 is supported to pivot about a vertical pin 54 (FIG. 5) supported in a clevis 55 at the brace frame lower end and carries a vertically extending flat rounded tongue 56 having a central horizontal bore.

Figure 2:
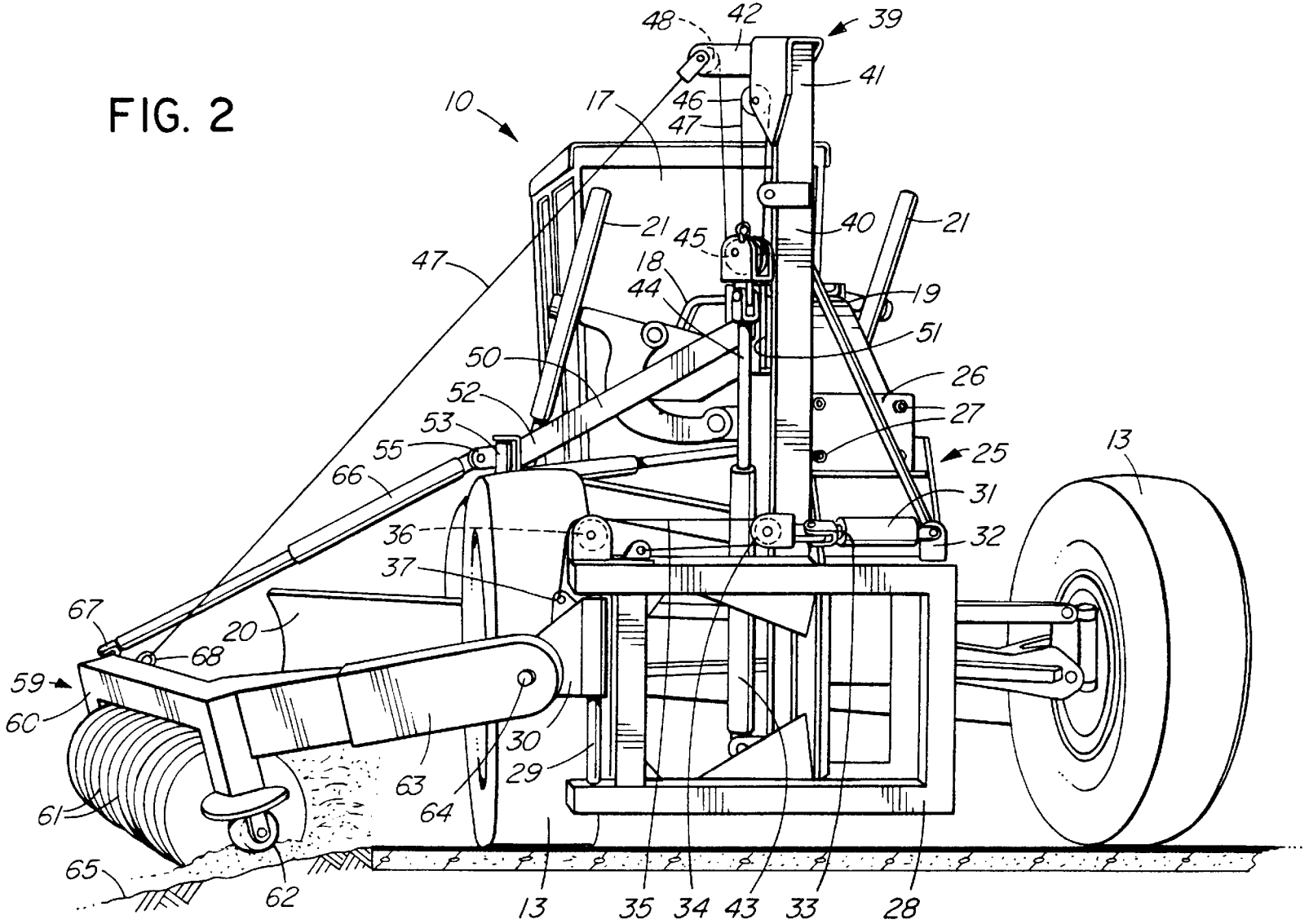
FIG. 2 is a front perspective view of the motor grader as shown in FIG. 1 illustrating the surface-conditioning equipment mounted outboard of the motor grader and in operation on a road shoulder.

FIG. 2 shows the attachment system in use forming a mounting for surface-conditioning equipment in the form of THE RETRIEVER. As is more fully described in the aforesaid Canadian patent, the entire content of which is incorporated herein by reference, THE RETRIEVER comprises a draft frame 60 supporting a series of coaxially arranged dished harrow discs, there being a ground-engaging support wheel 62 forward of the discs and the front portion of the draft frame comprising an angularly arranged draw bar 63 which is pivotally attached through a pin 64 to the bracket 30 for pivotal movement about the generally horizontal axis of the pin 64.

In its operative position as seen in FIGS. 1 and 2 THE RETRIEVER 59 is deployed outboard of the track of the motor grader with the discs 61 in contact with the ground surface of a road shoulder 65, the axis of the discs being at an angle of 15° to 35° to the fore-and-aft direction of the motor grader. To support THE RETRIEVER in this orientation, a telescopically adjustable strut 66 is deployed between the rear end of THE RETRIEVER draft frame and the brace frame 50. Specifically, an outboard end of the strut 66 is connected to the rear end of the draft frame 60 through a universal swivel connection 67, whereas an inboard end of the strut 66 is pivotally attached to the swivel bracket tongue 56. Additionally, the cable 47 is attached at one end to an eye 68 on the draft frame.

In operation, THE RETRIEVER is deployed as shown in FIGS. 1 and 2 with the discs 61 (which are oriented with their concave sides facing forward) lying in contact with the shoulder surface 65 to work and condition the shoulder surface material as the motor grader advances along the roadway. The discs are pressed into engagement with the shoulder surface 65 under the weight of the attachment itself which is free to pivot about the pin 64 at the front and the swivel bracket 53 at the rear. Thus with reference to FIG. 1 the line AC forms a rotation axis for THE RETRIEVER on the motor grader. The depth of penetration of the discs 61 is limited by the position of the wheel 62 (which is height adjustable) and by the cable 47 attached to the mast. THE RETRIEVER (or any other surface-conditioning attachment) is thus "free floating" under its own weight and can react to surface obstacles such as rocks by bouncing over them. In other words the surface conditioning equipment is not rigidly attached to the front mount system.

When THE RETRIEVER 59 is not in use, it is raised to an inoperative, transport position by retraction of the cable 47 through the mast arm 42. Specifically, retraction of the piston rod 44 creates a tension in the cable 47 and causes THE RETRIEVER 59 to be swung upwardly, pivoting about the axis AC to a transport position wherein it is substantially aligned with the fore-and-aft direction and does not project laterally outwardly of the motor grader to a great extent.

The height of the front end of THE RETRIEVER is also controlled to some extent by the bracket 30 to which the draw bar 63 is pivotally attached. During operation of the apparatus the bracket 30 may be allowed to move downwardly on the guide 29 under control of the hydraulic cylinder 31.

With reference to FIG. 1 it will be seen that the attachment system is effective to deploy THE RETRIEVER 59 in its operative position outboard of the forward end of the motor grader so that the moldboard 20 can be utilized without being in any way hampered by the presence of THE RETRIEVER. As used hitherto, THE RETRIEVER has been mounted on a post at the side of the motor grader to the rear of the mold board so that a second pass with the motor grader was necessary to dispose of shoulder material that may have been pushed onto the roadway by THE RETRIEVER. The new arrangement described herein represents a safety improvement during highway maintenance operations since the conditioned material brought from the shoulder onto the edge of the paved highway by THE RETRIEVER is immediately removed by the mold board following a few feet behind so that it does not remain to become a traffic hazard. Thus it becomes possible to effect both conditioning of the shoulder surface 65 by means of THE RETRIEVER 59, and movement of displaced shoulder surface material on the roadway (either back onto the shoulder if the roadway is paved, or to spread it on the roadway if the latter is unpaved) by means of the moldboard 20 which is suitably deployed for this purpose. Without the ability to mount THE RETRIEVER 59 from the front portion of the motor grader, the two operations would have to be performed using separate passes of the motor grader, and thus the novel attachment system of the present invention achieves considerable economies in the use of the motor grader in such operations.

Furthermore, as is evident in FIG. 3, the lower end 52 of the support arm 50 is located sufficiently forwardly of and above the moldboard 20 and its operating system 21 that it does not interfere with movement of the moldboard to the raised retracted inoperative position.

Various modifications of the above described attachment system can be made without departing from the scope of the invention as set out in the following claims. Thus, as has already been mentioned, the mounting frame could be designed for indirect connection to the nose plate of the motor grader using a "quick attach" coupling, and since the latter would include a hydraulic lifting mechanism, the attachment system as such could dispense with the hydraulic cylinder 31 and cable arrangement used to effect lifting movement of the bracket 30.

Additionally, the vertically extending mast 39 need not be permanently rigidly attached to the mounting frame, but could be designed to be folded downwardly when not in use so as to provide better visibility to the driver of the motor grader.

I claim:

1. An attachment system for mounting surface-conditioning equipment at the forward end of a tractor vehicle, such equipment comprising an elongate draft frame having an inboard end and an outboard end, said system comprising:

a rigid mounting frame configured to be fixedly connected in a releasable manner at least indirectly to a nose plate located at the front of the tractor vehicle such that said rigid mounting frame is cantilevered forwardly of said nose plate, said mounting frame including:

a bracket carried on said mounting frame and a connector on said bracket for providing pivotal attachment for the inboard end of the draft frame of the surface-conditioning equipment;

a remotely operable lift mechanism on said mounting frame for attachment to the draft frame at a location distant from said inboard end, and operable to effect a pivotal lifting action of said draft frame about said pivotal attachment at the inboard end thereof;

said attachment system functioning to carry the draft frame in an operative position at the forward end of and at least partially to one side of the tractor vehicle to draw the surface conditioning equipment, by means of the inboard end of the draft frame, over the ground surface upon forward movement of the vehicle, said lift mechanism being selectively operable to raise the draft frame to a retracted position by causing it to pivot upwardly about its inboard end.

2. The attachment system as claimed in claim 1 further comprising an elongate rigid brace frame adapted at one end for fixed attachment relative to the vehicle with a second end of the brace frame extending laterally to provide an anchor point accessible on one side of the vehicle, said anchor point being engageable by one end of a strut attachable at a second end to said draft frame to support the latter in its operative position.

3. The attachment system as claimed in claim 2 wherein said lift mechanism comprises a mast projecting upwardly from said mounting frame a cable drive in said mounting frame, cable guides in said frame and said mast to guide therein a flexible cable connected between said cable drive and a point on the draft frame near the outboard end, said cable guide being retractable to lift the draft frame to the retracted position, release of the cable allowing the draft frame to pivot downwards towards the operative position under the force of gravity.

4. The attachment system as claimed in claim 3 in combination with a tractor vehicle and including a length-adjustable strut engageable between said vehicle and a rearward portion of said draft frame, said strut functioning to support said draft frame at a predetermined angle of deployment relative to said tractor vehicle.

5. The combination of claim 4 wherein said tractor vehicle is a motor grader having front wheels and rear wheels supporting a longitudinally extending frame, a moldboard being mounted beneath said frame in an intermediate location and adjustable to perform surface conditioning operations, said rigid mounting frame being attached to a nose plate of said motor grader to support the draft frame of the surface-conditioning equipment at least partially outboard of one of the front wheels of the motor grader and forward of said moldboard in a location where it does not interfere with operation of either of said one front wheel and said moldboard.

6. The combination of claim 5 wherein said surface conditioning equipment comprises a gang of harrow discs arranged on a common axis extending longitudinally of the draft frame, said harrow discs having a concave curvature and being oriented each with the concave curvature facing the inboard end of the draft frame, said draft frame being movable between an operative position and a retracted position, in the operative position said discs being in contact with a ground surface outboard of said motor grader, said common axis being substantially parallel to said ground surface and oriented at an angle in the range 15° to 35° from the fore-and-aft direction of said motor grader, said draft frame being supported with said common axis in this orientation by said strut which is pivotally connected at one end to the draft frame and at an opposite end to said motor grader;

in the retracted position said draft frame being upwardly pivoted about its connection to said bracket so that said disc shaft is supported in a raised transport position closely aligned to the fore-and-aft direction of the motor grader.

7. The attachment system as claimed in claim 1 wherein said bracket is carried on a guide member fixed in said mounting frame and is movable on said guide member in a vertical sense to effect raising or lowering of said connector, a remotely operable powered actuator in said mounting frame connected to control movement of said bracket on said guide member.

8. The attachment system as claimed in claim 7 wherein said guide member is a linear guide that is oriented generally vertically of said mounting frame, said bracket being movable along on said linear guide.

9. The attachment system as claimed in claim 8 wherein said remotely operable powered actuator to effect movement of said bracket along said linear guide member comprises an hydraulic system configured for control from the driver's position in the vehicle.

10. The attachment system as claimed in claim 9 wherein said lift mechanism comprises a mast carried by said rigid mounting frame, a system of pulleys in said mast, said pulleys cooperating with a flexible cable which has one end that can be extended from the upper end of said mast for attachment to an outboard part of the draft frame, said lift mechanism including a powered cable drive operative to effect retraction of said cable into the top end of the mast.

11. The attachment system as claimed in claim 1 further including a length-adjustable strut engageable between the vehicle and a rearward portion of the draft frame and functioning to support the draft frame in the operative position at a predetermined angle relative to the travel direction of the vehicle.

12. An attachment system for mounting surface-conditioning equipment at the forward end of a tractor vehicle, such equipment comprising an elongate draft frame having an inboard end and an outboard end, said system comprising:

a rigid mounting frame configured to be fixedly connected in a releasable manner at least indirectly to a nose plate located at the front of the tractor vehicle, said mounting frame including:

a bracket carried on said mounting frame and a connector on said bracket for providing pivotal attachment for the inboard end of the draft frame of the surface-conditioning equipment;

a remotely operable lift mechanism on said mounting frame for attachment to the draft frame at a location distant from said inboard end, and operable to effect a pivotal lifting action of said draft frame about said pivotal attachment at the inboard end thereof;

wherein said bracket is carried on a linear generally vertical guide fixed in said mounting frame and is movable on said guide in a vertical sense to effect raising or lowering of said bracket, a remotely operable powered actuator in said mounting frame connected to control movement of said bracket on said guide member; and wherein said bracket has a tubular sleeve within which said linear guide is received, said bracket and sleeve being rotatable with respect to said linear guide;

said attachment system functioning to carry the draft frame in an operative position at the forward end of and at least partially to one side of the tractor vehicle to draw the surface conditioning equipment, by means of the inboard end of the draft frame, over the ground surface upon forward movement of the vehicle, said lift mechanism being selectively operable to raise the draft frame to a retracted position by causing it to pivot upwardly about its inboard end.

13. The attachment system as claimed in claim 12 wherein said connector defines a horizontal pivot axis in the attachment for said draft frame on said bracket.

14. A tractor vehicle comprising a motor grader having front wheels and rear wheels supporting a longitudinally extending frame, a moldboard being mounted beneath said frame in an intermediate location and adjustable to perform surface conditioning operations; in combination with an attachment system for mounting surface-conditioning equipment at the forward end of said longitudinally extending frame, such equipment comprising an elongate draft frame having an inboard end and an outboard end, said attachment system comprising:

a rigid mounting frame fixedly connected in a releasable manner at least indirectly to a nose plate located at the front of said longitudinally extending motor grader frame, said mounting frame including:

a bracket carried on said mounting frame and a connector on said bracket for providing pivotal attachment for the inboard end of the draft frame of the surface-conditioning equipment;

a remotely operable lift mechanism on said mounting frame for attachment to the draft frame at a location distant from said inboard end, and operable to effect a pivotal lifting action of said draft frame about said pivotal attachment at the inboard end thereof;

wherein said lift mechanism comprises a mast projecting upwardly from said mounting frame a cable drive in said mounting frame, cable guides in said frame and said mast to guide therein a flexible cable connected between said cable drive and a point on the draft frame near the outboard end, said cable guide being retractable to lift the draft frame to the retracted position by causing it to pivot upwardly about its inboard end, release of the cable allowing the draft frame to pivot downwards towards the operative position under the force of gravity;

said attachment system functioning to carry the draft frame in an operative position at the forward end of and at least partially to one side of the tractor vehicle to draw the surface conditioning equipment, by means of the inboard end of the draft frame, over the ground surface upon forward movement of the vehicle, to raise the draft frame to a retracted position;

an elongate rigid brace frame adapted at one end for fixed attachment relative to the vehicle with a second end of the brace frame extending laterally to provide an anchor point accessible on one side of the vehicle, said anchor point being engageable by one end of a strut attachable at a second end to said draft frame to support the latter in its operative position.

15. The combination of claim 14 wherein said strut is telescopically adjustable in length.

* * * * *